US006468140B1

(12) United States Patent
Wang

(10) Patent No.: US 6,468,140 B1
(45) Date of Patent: Oct. 22, 2002

(54) SWINGING DEVICE FOR A SANDING MACHINE

(76) Inventor: Chun-Hsiang Wang, P.O. Box 82-144, Taipei (TW)

( * ) Notice: Subject to any disclaimer, the term of this patent is extended or adjusted under 35 U.S.C. 154(b) by 50 days.

(21) Appl. No.: 09/637,196

(22) Filed: Aug. 14, 2000

(51) Int. Cl.[7] ..... B24B 21/00

(52) U.S. Cl. ..... 451/310; 451/139; 451/174; 451/236

(58) Field of Search ..... 457/310, 139, 457/174, 236, 280, 304, 162, 164, 168; 144/103

(56) References Cited

U.S. PATENT DOCUMENTS 1,212,214 A * 1/1917 Halterbeck ..... 451/304
4,267,671 A * 5/1981 Rettew ..... 451/300
4,742,650 A * 5/1988 Sauder et al. ..... 451/304
5,224,300 A * 7/1993 Pineau ..... 451/304
5,512,009 A * 4/1996 Earl ..... 451/300
5,702,287 A * 12/1997 Haney ..... 451/28
6,102,787 A * 8/2000 Schroeder et al. ..... 451/304
6,299,512 B1 * 10/2001 Costa et al. ..... 451/59

* cited by examiner

*Primary Examiner*—George Nguyen
(74) *Attorney, Agent, or Firm*—Leong C. Lei

(57) ABSTRACT

A swinging device for a sanding device, is disclosed. The swinging device has a swinging element, having mounted with a bi-axle motor, mounted to a sanding module, and the bi-axle motor synchronously drives a driving structure mounted to the swinging element, and the driving structure is provided with a shaft rod having an eccentric post, and the eccentric post is mounted to a limiting rod of the sanding module for limiting purpose, thus, when the bi-axle motor is initiated, the shaft rod is synchronously driven, and the eccentric post is used for limiting purpose. The entire swinging device causes the sanding module to produce a reciprocating swinging, and the sanding belt produces a tangential sanding effect.

4 Claims, 4 Drawing Sheets

SWINGING DEVICE FOR A SANDING MACHINE

BACKGROUND OF THE INVENTION (a) Technical Field of the Invention

The present invention relates to technology of sanding device, and in particular, to a swinging device mounting on the driving roller of the sanding module of the sanding device.

(b) Description of the Prior Art

Sanding machine is a device used in sanding the surface of wood material. Referring to FIG. 1, there is shown a conventional sanding machine having a machine body 10 mounted with a working platform 15 on the top thereof. One side of the platform 15 is provided with a sanding module 20 for the sanding of the surface of wood material. The sanding module 20 comprises a support frame 21 with two ends respectively mounted with a driving roller 22 and a driven roller 23. The driving roller 22 is connected to a motor 24 to drive a sanding belt 25 mounted around the driving roller 22 and the driven roller 23. The rotation of the sanding belt 25 polishes the material located on the working platform 15.

However, the sanding belt 25 of this conventional sanding machine provides a linear rotation, i.e., the position A on the sanding belt 25 moves horizontally to the point A. Thus, the material thereon is polished in a linear manner. As the particles of the sanding belt 25 contain very tiny gaps, the entire surface of the material cannot be polished. In other words, capillary holes on the surface of the material cannot be effectively removed. Additionally, the size of the material and the exertion force of the sanding belt 25 on the material are not always constant, and the exhaustion of particles of the sanding belt 25 is not uniform. Thus, the surface of the sanding belt 25 is irregular and the polished surface of the material will have similar irregularities, and the quality of the entire surface of the polished material is reduced. Therefore, it is an object of the present invention to provide a swinging device for a sanding machine, which can mitigate the drawbacks of the conventional sanding machine.

SUMMARY OF THE INVENTION

Accordingly, it is an object of the present invention is to provide a swinging device for a sanding device, wherein the swinging device has a swinging element, having mounted with a bi-axle motor, mounted to the sanding module, and the bi-axle motor synchronously drives a driving structure mounted to the swinging element, and the driving structure is provided with a shaft rod having an eccentric post, and the eccentric post is mounted to a limiting rod of the sanding module for limiting purpose. Thus, when the bi-axle motor is initiated, the shaft rod is synchronously driven, and the eccentric post is used for limiting purpose. The entire swinging device causes the sanding module to produce a reciprocating swinging, and the sanding belt produces a tangential sanding effect.

Yet another object of the present invention is to provide swinging device for a sanding machine, wherein the drawbacks of rough and uneven surface of the material are overcome, and the quality of sanding effect is improved.

Other objects and advantages of the present invention will become more apparent from the following description taken in conjunction with the accompanying drawing.

DETAILED DESCRIPTION OF THE PREFERRED EMBODIMENT

Figure 1:
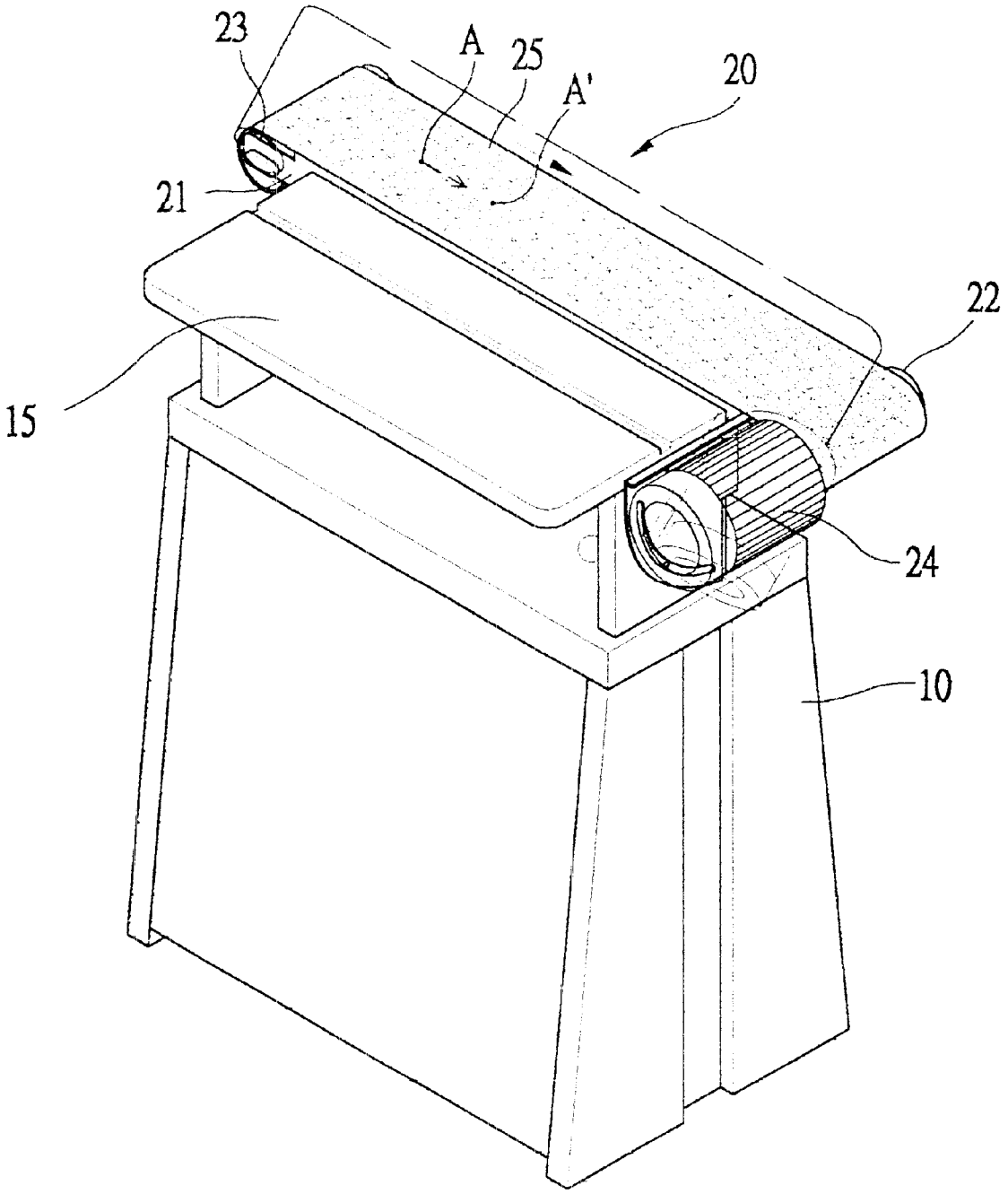
PRIOR ART FIG. 1
FIG. 1 is a perspective view of a conventional sanding machine showing the components of the machine and the working principle.
Figure 2:
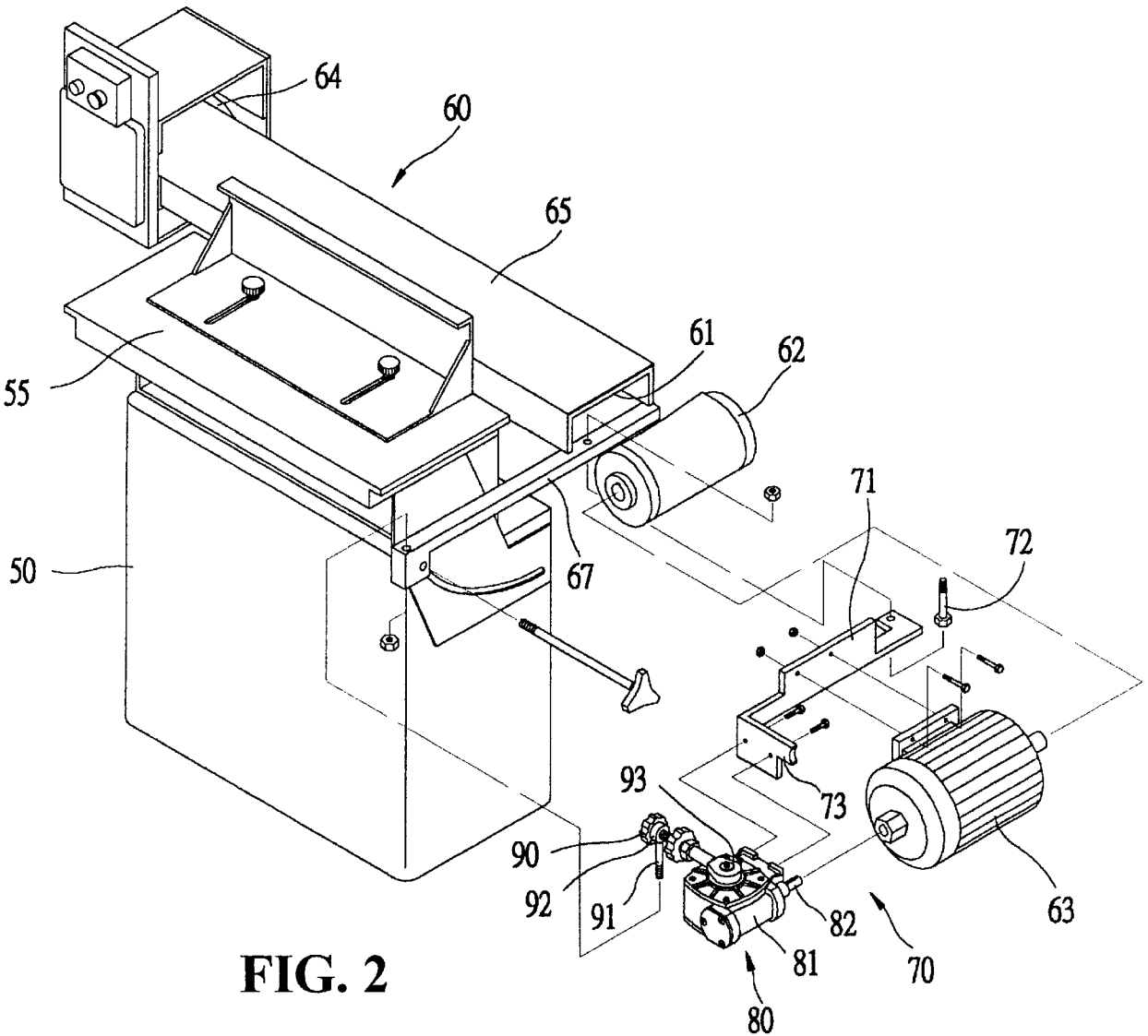
FIG. 2 is a perspective exploded view of the swinging device of the present invention, showing the components of the device and their related position.

Referring to FIG. 2, there is shown a swinging device for a sanding machine having a machine body 50 mounted with a working platform 55 thereon. One lateral side of the working platform 55 is mounted with a sanding module 60 comprising a sanding belt 65. The sanding module 60 comprises a support frame 61 with two ends, each mounted respectively with a driving roller 62 and a driven roller 64. The driving roller 62 is connected to a bi-axle motor 63 and the sanding belt 65 surrounds the driving roller 62 and the driven roller 64. Thus, after the sanding belt 65 is initiated, material located on the working platform 55 is proceeded to polish The other end of the bi-axle motor 63 is connected to a swinging device 70 mounted to the support frame 61. Thus, the end of the sanding module 60, corresponding to the bi-axle motor 63, produces a left and right swinging movement.

Figure 3:
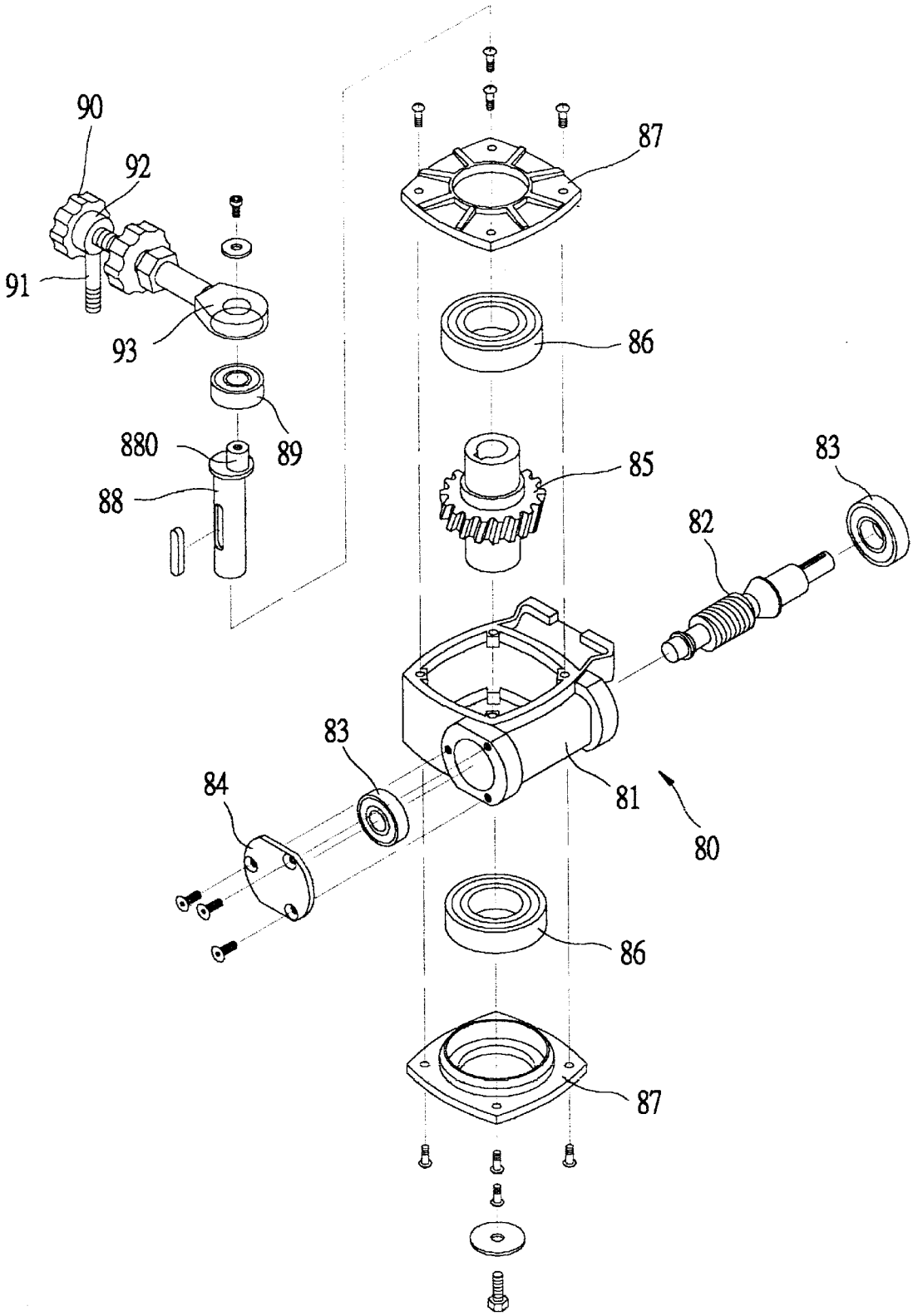
FIG. 3 is a perspective exploded view of the driving structure, showing the components of the driving structure.

The detailed structure of the swinging device 70 is shown in FIGS. 2 and 3. The support frame 61 of the sanding machine, adjacent to one end of the driving roller 62, is provided with a fixing rod 67 extended towards the working platform 55 for the pivotal mounting of the swinging device 70. The swinging device 70 comprises a swinging element 71, a driving structure 80 and a limiting rod 90 mounted to the fixing rod 67.

The swinging element 71, corresponding to one end of the support frame 61, is pivotally mounted to the fixing rod 67 by means of a pivotal rod 72 such that the swinging element 71 has a swinging relation with the support frame 61 of the sanding module 60. The bi-axle motor 63 of the sanding module 60 is mounted to the center section of the swinging element 71. The other end of the swinging element 71 is perpendicularly protruded to form a protruded plate 73. The protruded plate 73 is mounted with the driving structure 80, and the driving structure 80 is moved synchronously by the other end of the bi-axle motor 63.

Figure 4:
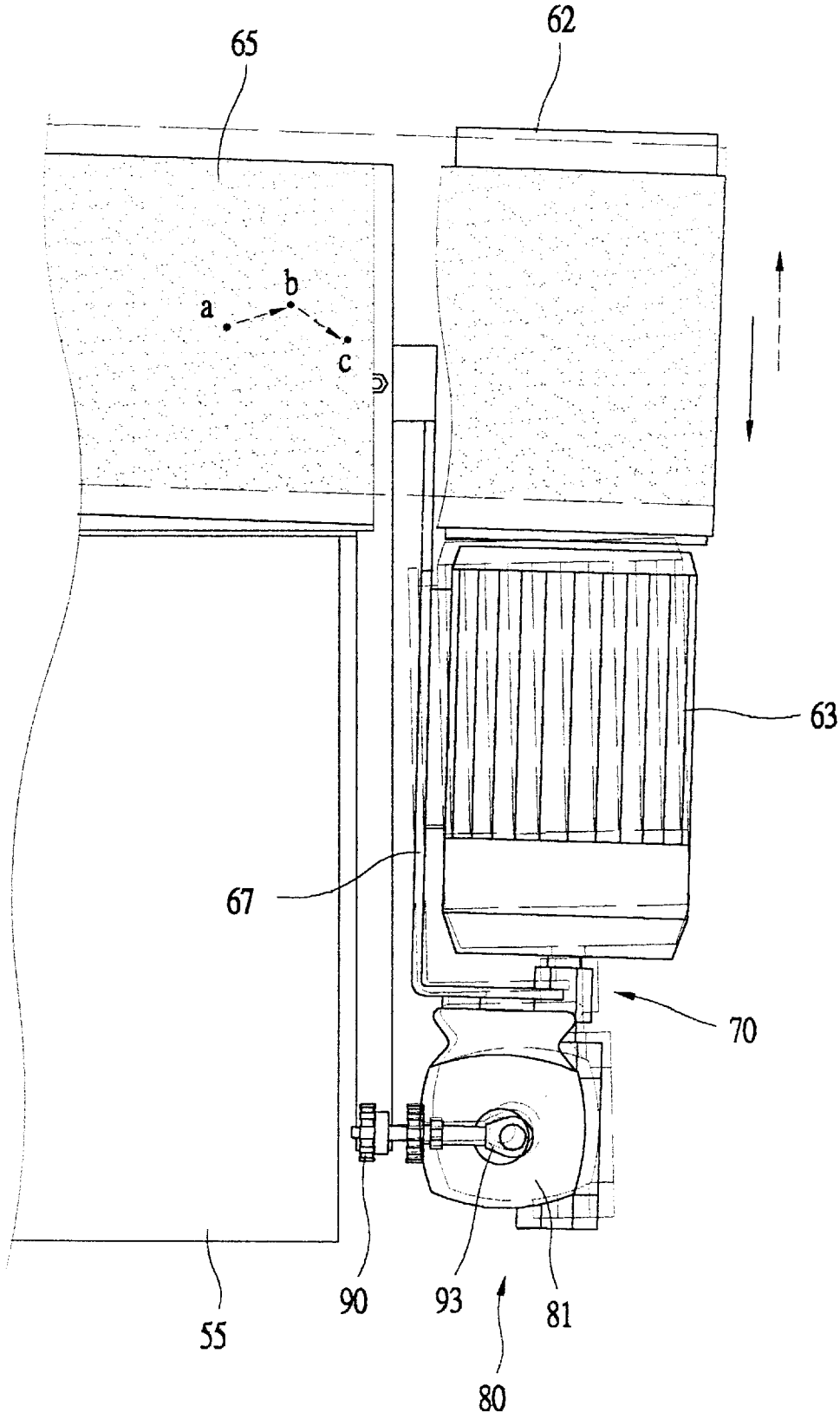
FIG. 4 is a schematic view illustrating the left, right action mode of the swinging device of the present invention.

Referring to FIGS. 2, 3 and 4, the driving structure 80 has a worm 82 connected to the bi-axle motor 63 by bearings 83 within a hollow frame body 81, such that the worm 82 can be driven by the bi-axle motor 63. The other lateral side of the frame body 81 is mounted with a lateral cover 84 to protect the worm 82. In addition, the internal of the frame body 81 is provided with a worm gear 85 which is in engagement with the worm 82 by means of bearings 86. The two ends of the bearings 86 are respectively mounted to a lateral cover 87 at the frame body 81. The end above the worm gear 85 is provided with a shaft rod 88 protruded out of the cover plate 87. The free end of the shaft rod 88 is formed into an eccentric post 880 mounted with a bearing 89.

The other end of the fixing rod 67 protruded out from the sanding module 60 is provided with the limiting rod 90. The limiting rod 90 has a screw rod shape which can be screwed to the limiting rod 91 of a screw sleeve 92. The lower end of a positioning rod 91 can be mounted onto the fixing rod 67. The free end of the limiting rod 90 is mounted to the bearing 89 of the shaft rod 88 of the driving structure 80.

This structure 80 allows the sanding belt 65 to move in a left and right direction, and the swinging device 70 for a sanding machine is obtained.

Referring to FIGS. 2, and 4, there are shown the application and the effectiveness of the swinging device of the present invention. When the bi-axle motor 63 of the sanding machine is initiated, it is used as the driving roller 62 of the sanding module 60, and the sanding belt 65 of the sanding module 60 is driven to rotate. At the same time, the bi-axle motor 63 synchronously drives the worm 82 of the driving structure 80 and the worm gear 85 engaged with the worm 82 also rotates synchronously. The rotating of the worm 85 causes the eccentric post 880 of the shaft rod 88 to produce an eccentric rotation, and the eccentric post 880 is restricted to a shaft sleeve 94 of the limiting rod 90 by means of the bearing 89. As the limiting rod 90 is directly mounted to the fixing rod 67, it can only driven the driving structure 80 in opposite direction to produce a swinging movement. As the driving structure 80 is mounted to the swinging element 71, and the swinging element 71 is mounted to the fixing rod 67, the swinging element 71 and the bi-axle motor 63 produce synchronously a swinging movement, and one end of the driving roller 62 of the sanding module 60 produces a reciprocating, eccentric movement, and in tun, the surrounded sanding belt 65 is caused to produce a left and right movement, and the sanding particles on the sanding belt 65 produce a reciprocating cutting force, which is shown in FIG. 4, wherein a point of the sanding belt 65 is moved to b point and then to c point, forming into a tangential sanding effect. This will greatly reduce the large capillary pores on the sanding surface, and the surface becomes smooth. In addition, as a result of sliding movement of the sanding particles, a uniform sanding effect is obtained which provides flatness to the sanding surface, and the quality of the entire sanding process is improved.

As the limiting rod 90 is locked at the fixing rod 67 of the positioning rod 91, when the limiting rod 90 is rotated, the distance of the shaft rod 88 of the driving structure 80 corresponding to the fixing rod 67 can be adjusted, thereby, the swinging angle of the swinging device 70 is adjusted.

While the invention has been described with respect to preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A swinging device for a sanding device having a working platform, one lateral side of the working platform being a sanding module having a sanding belt, and the sanding module comprising a driving roller and a driven roller mounted at each end of a support frame, the driving roller connected to a bi-axle motor having one end connected to a swinging device mounted onto the support frame, and a fixing rod being mounted at the lower end of the support frame, characterized in that the swinging device comprises a swinging element, a driving structure and a limiting rod mounted to the fixing rod, the swinging element, corresponding to one end of the support frame, is pivotally mounted on the fixing rod, and the bi-axle motor is located at the center section of the swinging element, and the other end of the swinging element is mounted to the driving structure, which is synchronously driven by the other end of the bi-axle motor, the driving structure is provided with an eccentric post which rotates eccentrically and the other end of the fixing rod protruded from the sanding module is mounted with the limiting rod, wherein the limiting rod can be locked to the eccentric post, thereby the swinging device allows the sanding belt to move in a left and right direction.

2. A swinging device for a sanding machine as set forth in claim 1, wherein the other end of the swinging element is mounted with a protruded plate for the mounting of the driving structure.

3. A swinging device for a sanding machine as set forth in claim 1, wherein the driving structure has a worm connected to the bi-axle motor and mounted with a bearing within a hollow frame body, the lateral side of the frame is provided with a cover plate, and a worm gear in engagement with the worm mounted with bearings are located within the frame body, and the two bearings are respectively located on the cover plate, and the top end of the worm gear is provided with a shaft rod, wherein the top end of the shaft rod has an eccentric post which is mounted with bearings.

4. A swinging device for a sanding machine as set forth in claim 1 or 3, wherein the limiting rod is a screw rod shape which can be screwed to a positioning rod having a screw sleeve, the lower end of the limiting rod is appropriately mounted to the fixing rod and the free end of the limiting rod is locked at the shaft rod of the driving structure.

* * * * *